US007259650B2

(12) United States Patent
Sano

(10) Patent No.: US 7,259,650 B2
(45) Date of Patent: Aug. 21, 2007

(54) MAGNETIC ELEMENT

(75) Inventor: Kan Sano, Tokyo (JP)

(73) Assignee: Sumida Electric Co., Ltd., Tokyo (JP)

( * ) Notice: Subject to any disclaimer, the term of this patent is extended or adjusted under 35 U.S.C. 154(b) by 0 days.

(21) Appl. No.: 11/426,637

(22) Filed: Jun. 27, 2006

(65) Prior Publication Data

US 2006/0290458 A1 Dec. 28, 2006

(30) Foreign Application Priority Data

Jun. 28, 2005 (JP) ..... P2005-188370

(51) Int. Cl.
*H01F 27/24* (2006.01)

(52) U.S. Cl. ..... 336/212; 336/182

(58) Field of Classification Search ..... 336/212, 336/155, 160, 170, 215, 165, 180–182
See application file for complete search history.

(56) References Cited

U.S. PATENT DOCUMENTS 4,931,761 A * 6/1990 Kijima ..... 336/160
5,306,350 A * 4/1994 Hoy et al. ..... 134/22.14
5,747,981 A * 5/1998 Callanan ..... 323/362
5,821,844 A * 10/1998 Tominaga et al. ..... 336/110
6,734,775 B2 * 5/2004 Chung ..... 336/198
6,967,553 B2 * 11/2005 Jitaru ..... 336/178
2002/0067237 A1 * 6/2002 Nakata et al. ..... 336/212
2006/0091989 A1 * 5/2006 Vinciarelli et al. ..... 336/216

* cited by examiner

*Primary Examiner*—Anh Mai
(74) *Attorney, Agent, or Firm*—Sonnenschein Nath & Rosenthal LLP

(57) ABSTRACT

A magnetic element including coils; a first core and a second core each of which has a planar plate portion, outer leg portions and a middle leg portion which is inserted into aforesaid coil; and an intermediate core to form a closed magnetic circuit which is disposed between the aforesaid first core and the aforesaid second core in a manner connecting integrally with the aforesaid first core and aforesaid second core. In addition, the magnetic element is made into a configuration that has relations of S1≦S3 and also S1≦S2 when a cross-sectional area of the middle leg portion of the aforesaid first core is S1, a cross-sectional area of the aforesaid intermediate core is S2 and a cross-sectional area of the middle leg portion of the aforesaid second core is S3.

8 Claims, 8 Drawing Sheets

MAGNETIC ELEMENT

CROSS REFERENCES TO RELATED APPLICATIONS

The present application claims priority to Japanese Application No. P2005-188370 filed on Jun. 28, 2005, which application is incorporated herein by reference to the extent permitted by law.

BACKGROUND OF THE INVENTION

1. Field of the Invention

The present invention relates to a magnetic element and more particularly relates to an inductance element that is used for a power source.

2. Description of the Related Art

In recent years, a size reduction of a magnetic element has been strongly required due to a reason such as a substrate configuration of high density mounting and multilayer array, and at the same time it has been strongly required to lower a cost of product. As a form of a magnetic element in the past, there has been known such one that adopts a configuration combining a flanged core and ring-type core made of ferrite magnetic cores (for example, refer to Patent Reference 1). In addition, a magnetic element combining so-called E-type core and I-type core has been also well known.

Furthermore, there has been known a circuit configuration 100 in which a plurality of magnetic elements (inductance elements, for example) 101 having the same or similar electric characteristic or shape are disposed on a mounting substrate as shown in FIG. 1.

[Patent Reference 1] Published Japanese Patent Application No. 2002-313635

SUMMARY OF THE INVENTION

However, when the plurality of inductance elements 101 having the same or similar electric characteristic or shape are disposed on the mounting substrate as shown in FIG. 1, it is necessary to secure a mounting space proportional to a layout area of those inductance elements on the mounting substrate and there arises such a problem that the mounting substrate becomes large.

Moreover, since a mounting element to be mounted on a mounting substrate, which is not limited to an inductance element, needs to keep an appropriate interval to an adjacent mounting element in order to prevent damages of the element during mounting work, there arises such a problem that a layout area of inductance elements to be mounted needs to be further reduced in order to satisfy a recent requirement of high density mounting at a high level.

In consideration of the problems described hereinbefore, the present invention is to provide with a magnetic element that reduces a layout area on a mounting substrate.

A magnetic element according to an embodiment of the present invention is configured to have coils; a first core and a second core each of which has a planar plate portion, outer leg portions and a middle leg portion which is inserted into the aforesaid coil; and an intermediate core to form a closed magnetic circuit which is disposed between the aforesaid first core and the aforesaid second core in a manner being integrally connected with the aforesaid first core and aforesaid second core. In addition, the magnetic element is made into a configuration that has relations of $S1 \leqq S3$ and also $S1 \leqq S2$ when a cross-sectional area of the middle leg portion of the aforesaid first core in a vertical direction to a stretching direction of the aforesaid outer leg portion is S1, a cross-sectional area of the aforesaid intermediate core in a parallel direction to a stretching direction of the aforesaid outer leg portion is S2 and a cross-sectional area of the middle leg portion of the aforesaid second core in a vertical direction to a stretching direction of the aforesaid outer leg portion is S3.

Desirably, it is suitable that the magnetic element according to the embodiment of the present invention has a gap between the aforesaid intermediate core and a top end portion of the aforesaid middle leg portion.

More desirably, it is suitable that the aforesaid coil of the magnetic element according to the embodiment of the present invention is an edgewise wound coil of a flat wire.

As described hereinbefore, the magnetic element according to the embodiment of the present invention reduces the layout area of the magnetic element on the mounting substrate by using a common core to flow magnetic fluxes generated from the plurality of cores.

According to the magnetic element related to the embodiment of the present invention, it is possible to mount the plurality of magnetic elements in high density on the mounting substrate since the layout area of the magnetic elements can be reduced on the mounting substrate.

DESCRIPTION OF THE PREFERRED EMBODIMENTS

Although preferred embodiments of the present invention are explained hereinafter by referring to the accompanied drawings, it is apparent that the present invention is not limited to the following embodiments.

Figure 1:
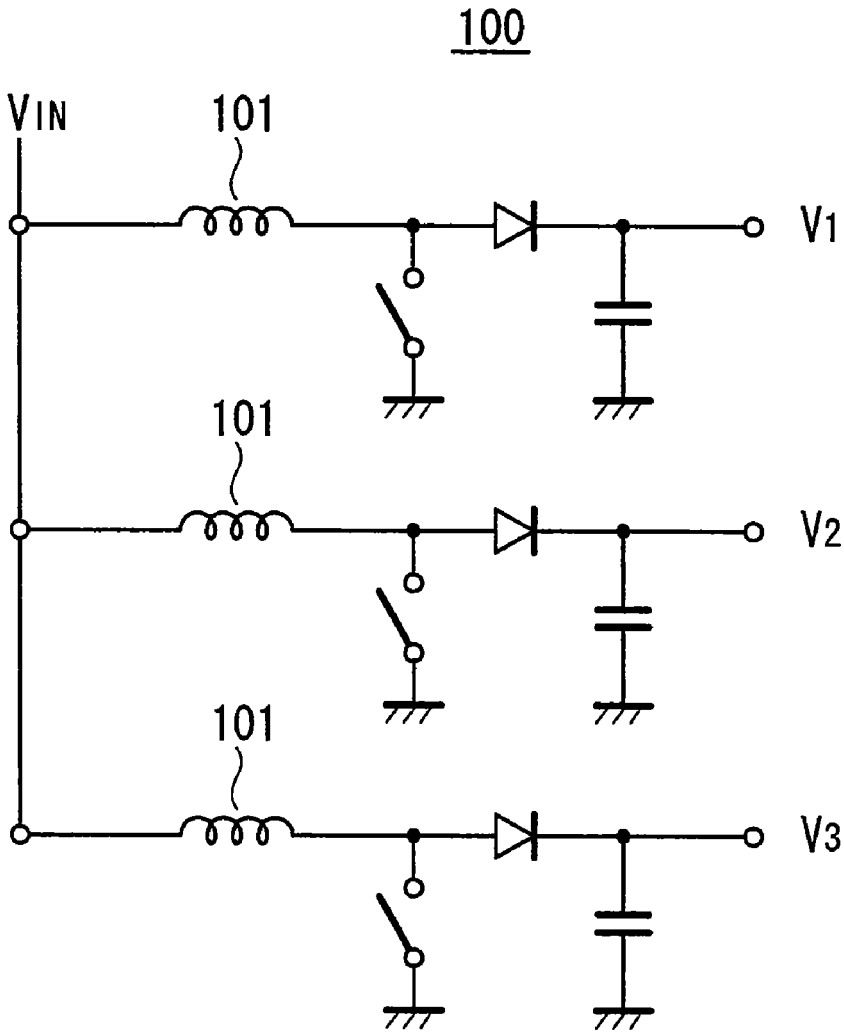
FIG. 1 (RELATED ART)
FIG. 1 is a diagram showing a circuit configuration of related art disposing a plurality of magnetic elements.
Figure 2:
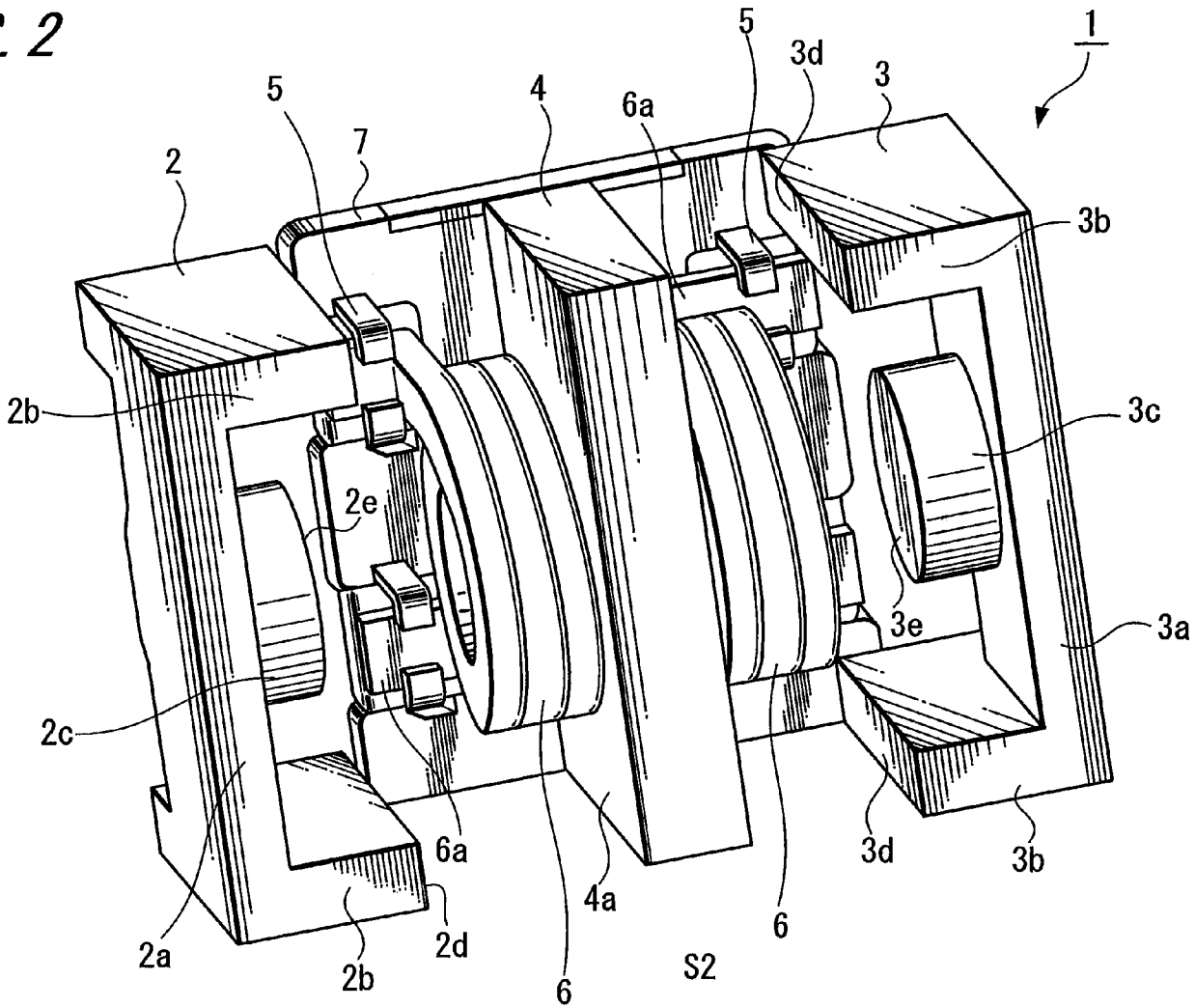
FIG. 2 is an exploded perspective view of a magnetic element according to an embodiment of the present invention.

FIG. 2 is an exploded perspective view of a magnetic element according to an embodiment of the present invention.

As shown in FIG. 2, an inductance element 1 as a magnetic element is configured to have a first core 2, a second core 3, an intermediate core 4, terminal members 5, coils 6 and a support base 7.

The first core 2 is configured to have a rectangle-shaped planar plate 2*a*, outer legs 2*b* that are formed at both end portions of the planar plate 2*a* and a middle leg 2*c* that is provided around a center portion of the planar plate 2*a*. A cut-out portion 2*f* (refer to FIG. 3) is formed into one end portion in a widthwise direction of the planar plate 2*a* in order to relieve terminal portions 6*a* of the coil 6 when the inductance element 1 is completed.

In the both end portions of a lengthwise direction of the planar plate 2*a*, the outer legs 2*b* are formed in a direction stretching toward a vertical direction to the planar plate 2*a*, and a top end surface 2*d* having a parallel plane to the planar plate 2*a* is formed in a top end portion of each outer leg 2*b*.

The cylindrical column-shaped middle leg 2*c* stretching toward the same direction as the stretching direction of the outer leg 2*b* is formed around an approximately central part of the planar plate 2*a*, and a top end surface 2*e* having a parallel plane to the planar plate 2*a* is formed in a top end portion of the middle leg 2*c*. In addition, a length of the middle leg 2*c* is set shorter than a length of the outer leg 2*b* in order to form a gap between the top end surface 2*e* of the middle leg and the intermediate core 4. Here, although the shape of the middle leg 2*c* is set into the cylindrical column shape in this embodiment, the shape of the middle leg 2*c* may be a rectangular shape, for example, without being limited to this shape.

Similarly to the first core 2, the second core 3 is configured to have a rectangle-shaped planar plate portion 3*a*, outer legs 3*b* that are formed at both end portions of the planar plate portion 3*a* and a middle leg 3*c* that is provided around a center portion of the planar plate 3*a*. In addition, the second core 3 is molded into the same structure as the first core 2. In the both end portions of a lengthwise direction of the planar plate 3*a*, the outer legs 3*b* are formed in a direction stretching toward a vertical direction to the planar plate 3*a*, and a top end surface 3*d* having a parallel plane to the planar plate 2*a* is formed in a top end portion of each outer leg 3*b*.

The cylindrical column-shaped middle leg 3*c* stretching toward the same direction as the stretching direction of the outer leg 2*b* is formed around an approximately central part of the planar plate 3*a*, and a top end surface 3*e* having a parallel plane to the planar plate 3*a* is formed in a top end portion of the middle leg 3*c*. In addition, a length of the middle leg 3*c* is set shorter than a length of the outer leg 3*b* in order to form a gap between the top end surface 3*e* of the middle leg and the intermediate core 4.

Here, although the first core 2 and the second core 3 are formed into the same structure in this embodiment, the structures of the first core 2 and second core 3 are not limited thereto and may be molded into structures that are different from each other. In addition, the first core 2 and the second core 3 are formed of a magnetic material using Mn—Zn type ferrite.

The intermediate core 4 is configured into a rectangle-shaped planar plate and has planar surfaces 4*a* respectively opposing to the top end surfaces 2*d* formed in the outer legs 2*b* of the first core 2, the top end surface 2*e* formed in the middle leg 2*c* and the top end surfaces 3*d* formed in the outer legs 3*b* of the second core 3, the top end surface 3*e* formed in the middle leg 3*c*. In addition, the intermediate core 4 is formed such that a length of the intermediate core 4 in a lengthwise direction becomes the same length as those of the first core 2 and second core 3 in the lengthwise directions. Furthermore, the intermediate core 4 is formed such that a length of the intermediate core 4 in a widthwise direction becomes the same length as those of the first core 2 and second core 3 in the widthwise directions. It should be noted that the intermediate core 4 is formed of a material using Mn—Zn type ferrite and mold-pressed into the rectangular shape by metal mold press, for example.

The coil 6 is the edgewise wound coil of the flat wire and is molded such that the coil has an air core. More specifically, the coil is molded by winding edgewise the flat wire coated with an insulation layer. In addition, the coil terminal portions 6*a* are formed in the coil 6 in order to flow electric current supplied form a mounting substrate, on which the inductance element 1 is mounted, into the coil.

The base member 7 is molded by using a planar plate-shaped member having an approximately rectangular shape. In addition, the terminal members 5 each of which has a support portion for holding the terminal portion 6*a* of the coil 6 are attached to the base member 7, and the base member 7 is formed such that a part of each terminal member 5 is exposed to a side that is mounted on the mounting substrate.

Figure 3:
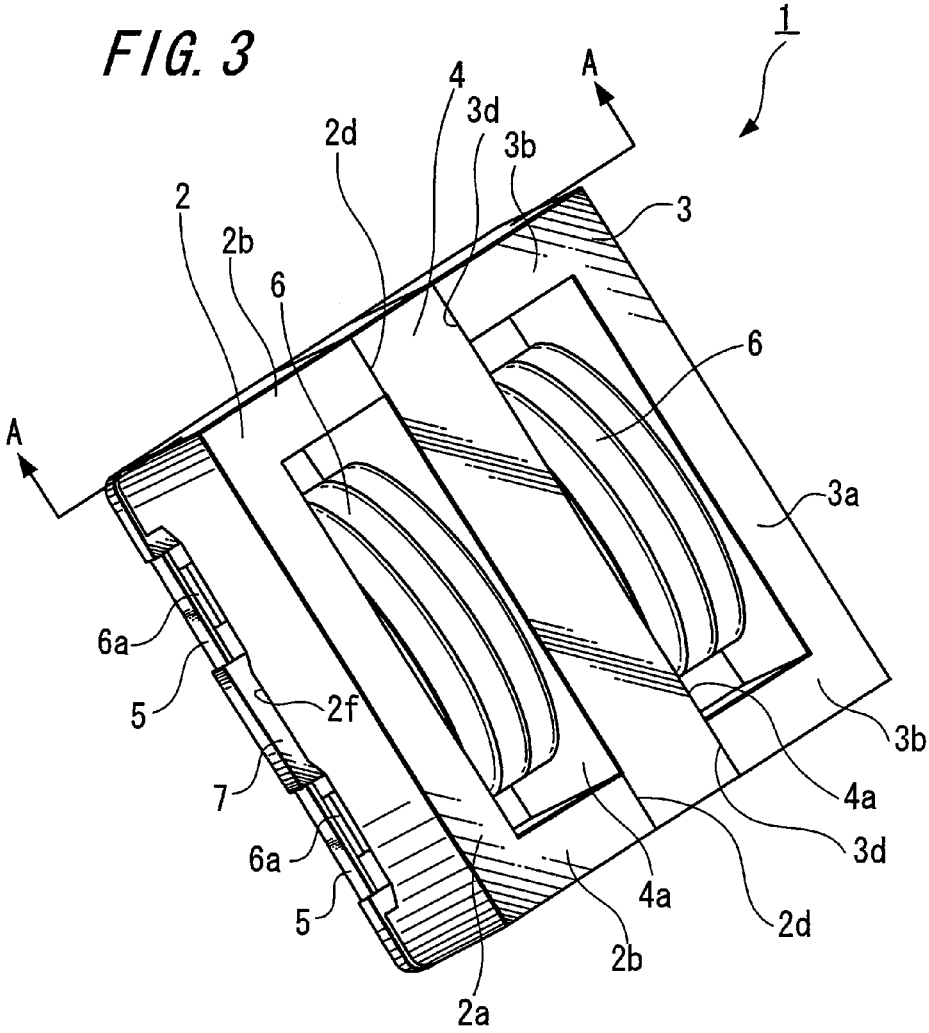
FIG. 3 is a perspective view of the magnetic element according to the embodiment of the present invention.

FIG. 3 is a perspective view of the magnetic element according to the embodiment of the present invention.

As shown in FIG. 3, the first core 2 and the second core 3 are disposed such that the outer legs 2*b* and middle leg 2*c* of the first core 2 and the outer legs 3*b* and middle leg 3*c* of the second core 3 face each other across the intermediate core 4 in the assembled inductance element 1. In addition, the coil 6 is disposed between the intermediate core 4 and the planar plate 2*a* of the first core 2. At this time, the middle leg 2*c* of the first core 2 is inserted into the air core of the coil 6. Similarly, the coil 6 is also disposed between the intermediate core 4 and the planar plate 3*a* of the secondary core 3, and the middle leg 3*c* is inserted into the air core of the coil.

More specifically, closed magnetic circuits are formed by the first core 2, the second core 3 and the intermediate core 4 in the inductance element 1. Describing further details, the closed magnetic circuits are respectively formed by the middle leg 2*c*, planar plate 2*a*, outer legs 2*b* which belong to the first core 2, the intermediate core 4 and a later-described gap g, and also by the middle leg 3*c*, planar plate 3*a*, outer legs 3*b* which belong to the second core 3, intermediate core 4 and a later-described gap g.

In the inductance element 1, the first core 2, the second core 3 and the intermediate core 4 are assembled together such that the top end surfaces 2*d* of outer legs 2*b* of the first core and the top end surfaces 3*d* of outer legs 3*b* of the second core respectively fit to the planar surfaces 4*a* of the intermediate core 4. In this embodiment, since the first core 2, the second core 3 and the intermediate core 4 are formed such that the length of the widthwise direction in each of the planar plate 2*a* of the first core 2 and the planar plate 3*a* of the second core 3 becomes the same length as the length of the widthwise direction in the intermediate core 4, two planar surfaces are formed on the top and bottom in the widthwise direction when the first core 2, the second core 3 and the intermediate core 4 are assembled together. Out of those two planar surfaces, the support base 7 is attached to the planar surface that is formed on the side where the cut-off portion 2*f* of the first core 2 and the cut-off portion 3*f* of the second core 3 are provided.

Four pieces of terminal members 5 are attached to the support base 7, and those terminal members 5 hold the terminal portions 6*a* of the coils while maintaining a state that the middle legs 2*c* and 3*c* are inserted in the coils 6. In addition, the terminal portions 6*a* of the coils are disposed at positions located in the spaces formed by the cut-off portion 2*f* of the planar plate 2*a* and the cut-off portion 3*f* of the planar plate 3*a*. Here, the top end surfaces 2*d* of the outer legs 2*b* and the top end surfaces 3*d* of the outer legs 3*b* are fixed respectively to the planar surfaces 4*a* of the intermediate core 4 corresponding to those surfaces by applying adhesive thereto when the first core 2, the second core 3 and the intermediate core 4 are assembled together.

The assembled inductance element 1 is mounted on the mounting substrate in a state that a contact between the terminal members 5 exposed to the backside of the support base 7 and the mounting substrate (not illustrated) is maintained by soldering. Thereby, the electric current supplied from the mounting substrate is supplied to the inductance element 1 through the terminal members 5.

According to the inductance element 1 of this embodiment, the inductance element can be easily manufactured since all of the first core 2, second core 3 and intermediate core 4 are molded into simple structures.

Figure 6:
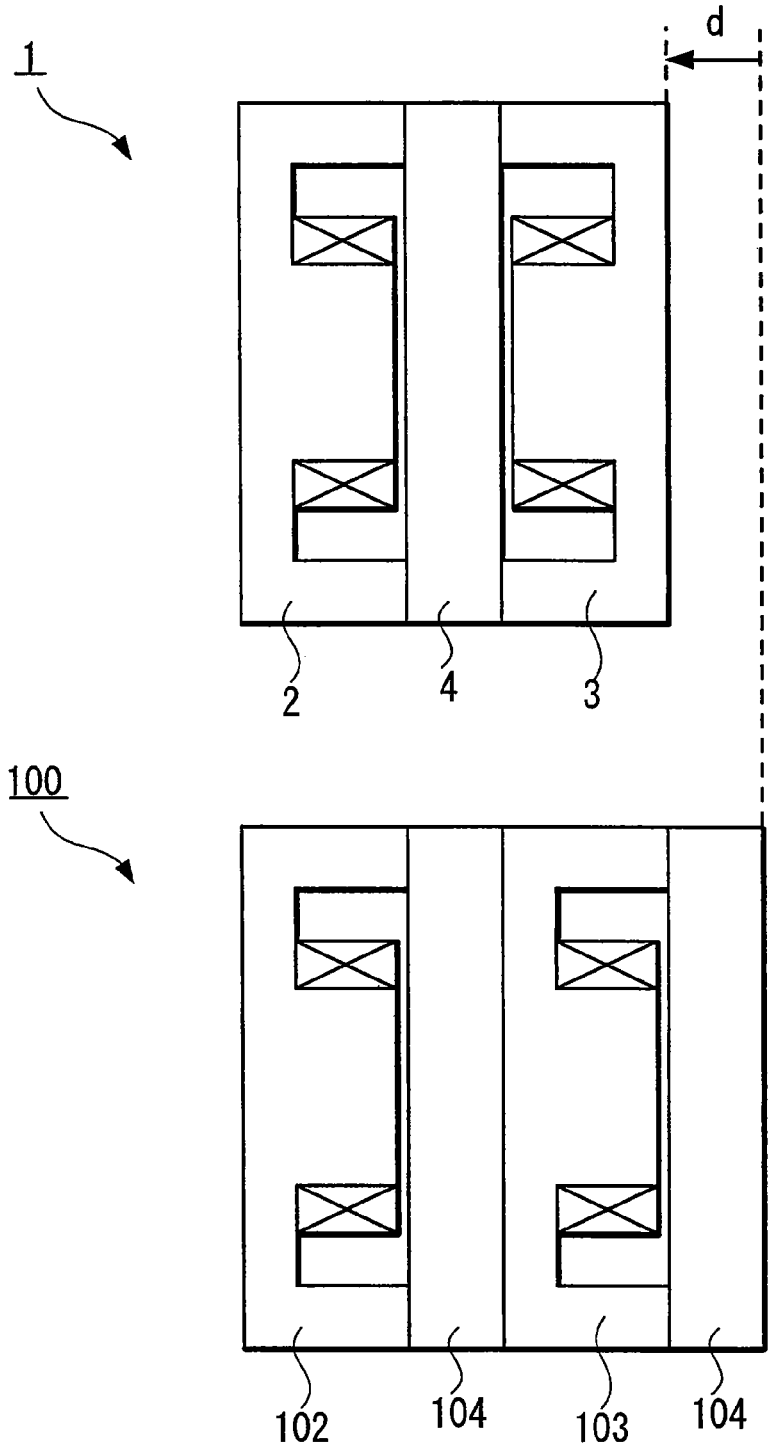
FIG. 6 is a cross-sectional view when a magnetic element of related art is compared to the magnetic element according to the embodiment of the present invention.

In addition, a layout area can be reduced by length d in the inductance element 1 of this embodiment as shown in FIG. 6 when the inductance element 1 of this embodiment is compared with a previous structure having two sets of inductance elements 101 stuck together. More specifically, two sets of inductance elements 101 used in the past can be integrated into one so that one's own layout area of the inductance element can be reduced on the mounting substrate according to the inductance element 1 of this embodiment. Furthermore, two sets of coils 6 can be provided in one element without causing to have magnetic coupling according to the inductance element 1 of this embodiment.

Figure 4:
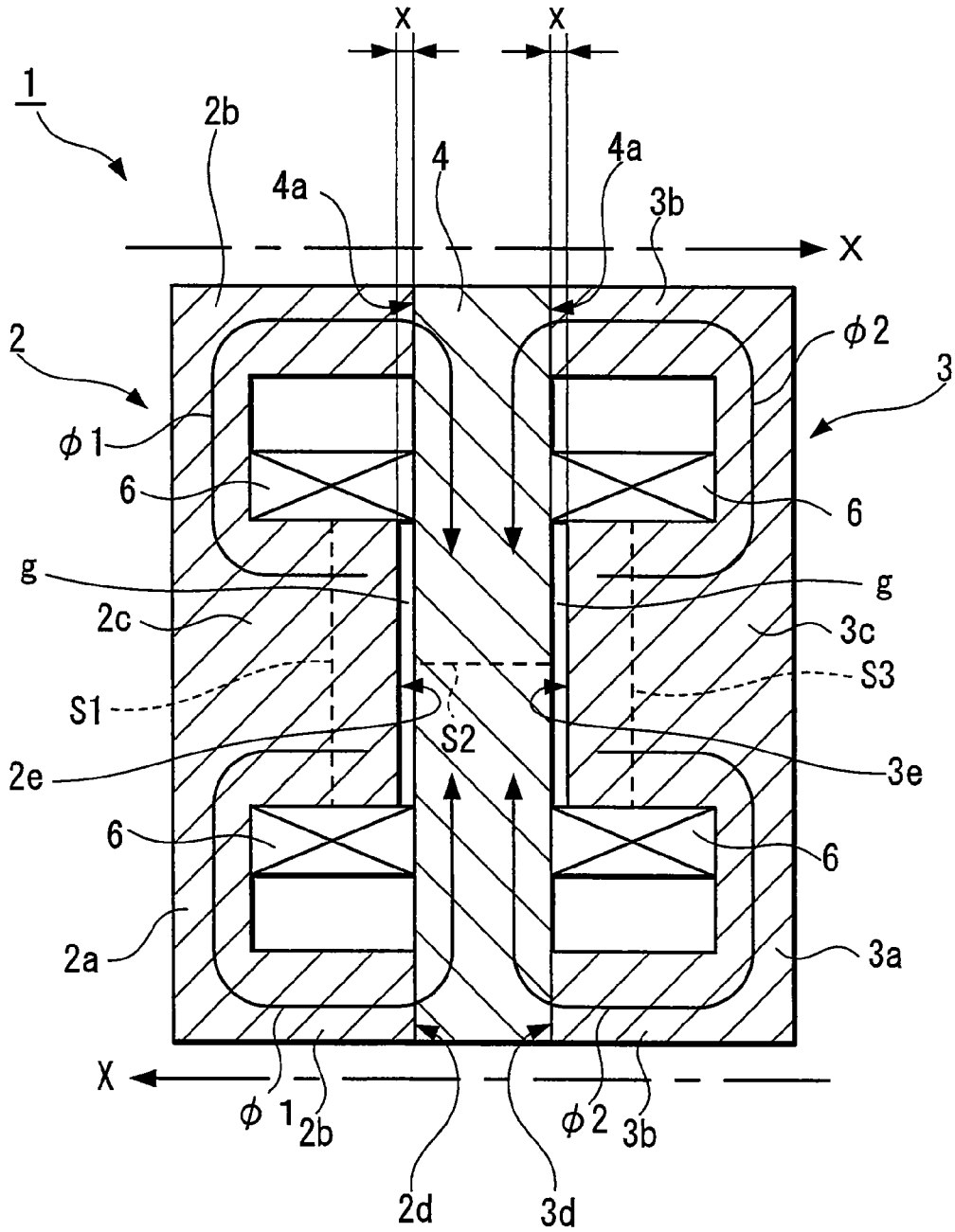
FIG. 4 is a cross-sectional view of the magnetic element according to the embodiment of the present invention.

FIG. 4 is an outline cross-sectional view of the magnetic element according to the embodiment of the present invention which is taken on A-A line shown in FIG. 3.

As shown in FIG. 4, the middle leg 2*c* of the first core 2 and the middle leg 3*c* of the second core 3 are respectively inserted into the air cores of coils 6. Gaps g each of which has spacing x are formed respectively between the top end surface 2*e* of the middle leg 2*c* and the planar surface 4*a* of the intermediate core, and between the top end surface 3*e* of the middle leg 3*c* and the planar surface 4*a* of the intermediate core.

Here, as another method of providing the gaps in the magnetic path, the gaps may be provided by disposing spacer members for forming the gaps respectively between the intermediate core 4 and the first core 2, and between the intermediate core 4 and the second core 3. In addition, as further another method thereof, effective magnetic permeability of the intermediate core 4 is set lower than effective magnetic permeability of the first core 2 and second core 3 so that a practical action as the gaps can be obtained. It should be noted that various alterations such as one using a magnetic material of lower permeability and one using a mixture of resin and magnetic powder as a material of the core are possible when this method is used.

According to the inductance element 1 of this embodiment, even when this inductance element is used for a purpose of power source that flows large electric current, it is not necessary to provide gaps newly between the outer legs 2*b*, the outer legs 3*b* and the intermediate core 4 respectively since the inductance element has the gaps g respectively between the first core 2 and the intermediate core 4, and between the second core 3 and the intermediate core 4. Accordingly, it is possible to flow large electric current in the inductance element 1 while maintaining assembly strength of the first core 2 and second core 3 with the intermediate core 4.

In addition, since the edgewise wound coil of the flat wire is used as the coil 6 according to the inductance element 1 of this embodiment, the resistance can be reduced due to a reason that a cross-sectional area of the coil becomes large and also a size reduction of the inductance element becomes possible due to a reason that there is no unnecessary gap in the coil.

When the electric current is flown in the coil 6, magnetic fluxes Φ1 passing through the middle leg 2*c*, planar plate 2*a*, outer legs 2*b* of the first core 2 and the intermediate core 4, and also magnetic fluxes Φ2 passing through the middle leg 3*c*, planar plate 3*a*, outer legs 3*b* of the second core 3 and the intermediate core 4 are generated toward directions of arrow marks shown by using solid lines in FIG. 4. It should be noted that the directions of magnetic fluxes Φ1 and Φ2 generated in the closed magnetic paths change depending on the kind of electric current flowing in the coils 6 and winding directions of the coils.

Here, it is respectively defined that a cross-sectional area of a vertical direction to a stretching direction of the outer leg 2*b* is S1 in the middle leg 2*c* of the first core 2, a cross-sectional area of a parallel direction to a stretching direction of the outer legs 2*b* and 3*b* is S2 in the intermediate core 4 and a cross-sectional area of a vertical direction to a stretching direction of the outer leg 3*b* is S3 in the middle leg 3*c* of the second core 3. It should be noted that arrow marks x shown in FIG. 4 by using alternate long and short dash lines indicate directions to which the outer legs 2*b* provided on the first core 2 and the outer legs 3*b* provided on the second core 3 stretch.

Figure 5:
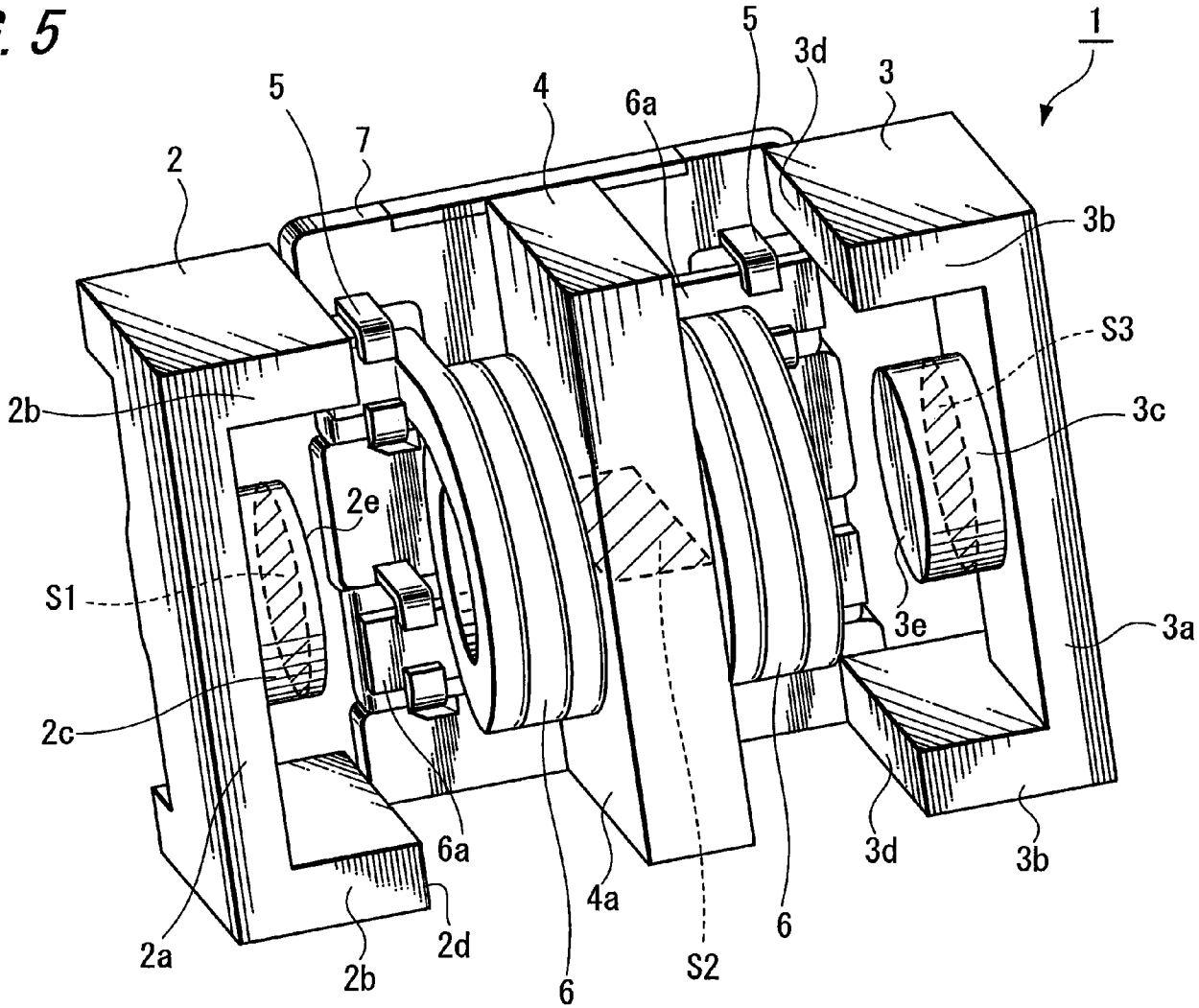
FIG. 5 is an exploded perspective view of the magnetic element according to the embodiment of the present invention.

FIG. 5 is an exploded perspective view of the magnetic element according to the embodiment of the present invention and perspectively shows the cross-sectional areas S1, S2 and S3 shown in FIG. 4. In FIG. 5, it should be noted that the same reference numerals are given to those corresponding to FIG. 2 and duplicated explanations thereof are omitted.

As shown in FIG. 5, the cross-sectional area S1 in the middle leg 2*c* of the first core 2 has the same area as the top end surface 2*e* of the middle leg 2*c*, and similarly the cross-sectional area S3 in the middle leg 3*c* of the second core 3 has the same area as the top end surface 3*e* of the middle leg 3*c*. In this embodiment, the middle leg 2*c* and the middle leg 3*c* are formed such that the cross-sectional area S1 and the cross-sectional area S3 have the same area, but the middle leg 2*c* and the middle leg 3*c* may be formed such that the cross-sectional area S3 becomes larger than the cross-sectional area S1, for example.

The cross-sectional area S2 in the intermediate core 4 is a cross-sectional area in a center portion of a lengthwise direction of the intermediate core 4. Here, a cross-sectional area that comes out at the time of cutting the intermediate core 4 into a parallel direction along a line connecting the center points of the air cores of two coils 6 is defined as S2 when a shape of the intermediate core 4 is not the shape having the uniform cross-sectional area as this embodiment.

According to the inductance element 1 of this embodiment, an overall balance in magnetic saturation of the first core 2, second core 3 and intermediate core 4 can be maintained for various usages since S1, S2 and S3 are set into S1≦S3 and also S1≦S2 when the cross-sectional area of the middle leg 2*c* of the first core 2 is S1, the cross-sectional area of the middle leg 3*c* of the second core 3 is S3 and the cross-sectional area of the intermediate core 4 is S2.

Further, in case of S1≦S3 and S1=S2, the magnetic saturation is not caused when the electric current is flowed in either one coil out of the coil 6 of the first core 2 or the coil 6 of the second core 3, and in addition it is possible to reduce the layout area of the inductance element 1. Furthermore, in case of S2=S1+S3, it is possible to operated two inductors by flowing the electric current simultaneously in the coils 6 of the first core 2 and second core 3.

Here, in case of S1≦S3 and S1>S2, the magnetic saturation is first caused in the intermediate core 4 when excess electric current is flowed at least in one side of the coils 6 since the cross-sectional area S2 of the intermediate core 4 is practically smaller than the cross-sectional area S1 of the middle leg 2*c* of the first core 2. Accordingly, there is a possibility to cause a rapid decrease in electric characteristic (typically, an inductance value) of the inductance element 1. In addition, there is a possibility that mechanical strength and rigidity of the inductance element 1 decrease since the cross-sectional area S2 of the intermediate core 4 becomes small.

According to the considerations described hereinbefore, the inductance element 1 of this embodiment is made into a configuration that has the relation of S1≦S3 and also S1≦S2 when the cross-sectional area of the middle leg 2*c* of the first core 2 is S1, the cross-sectional area of the intermediate core 4 is S2 and the cross-sectional area of the middle leg 3*c* of the second core 3 is S3.

Figure 7:
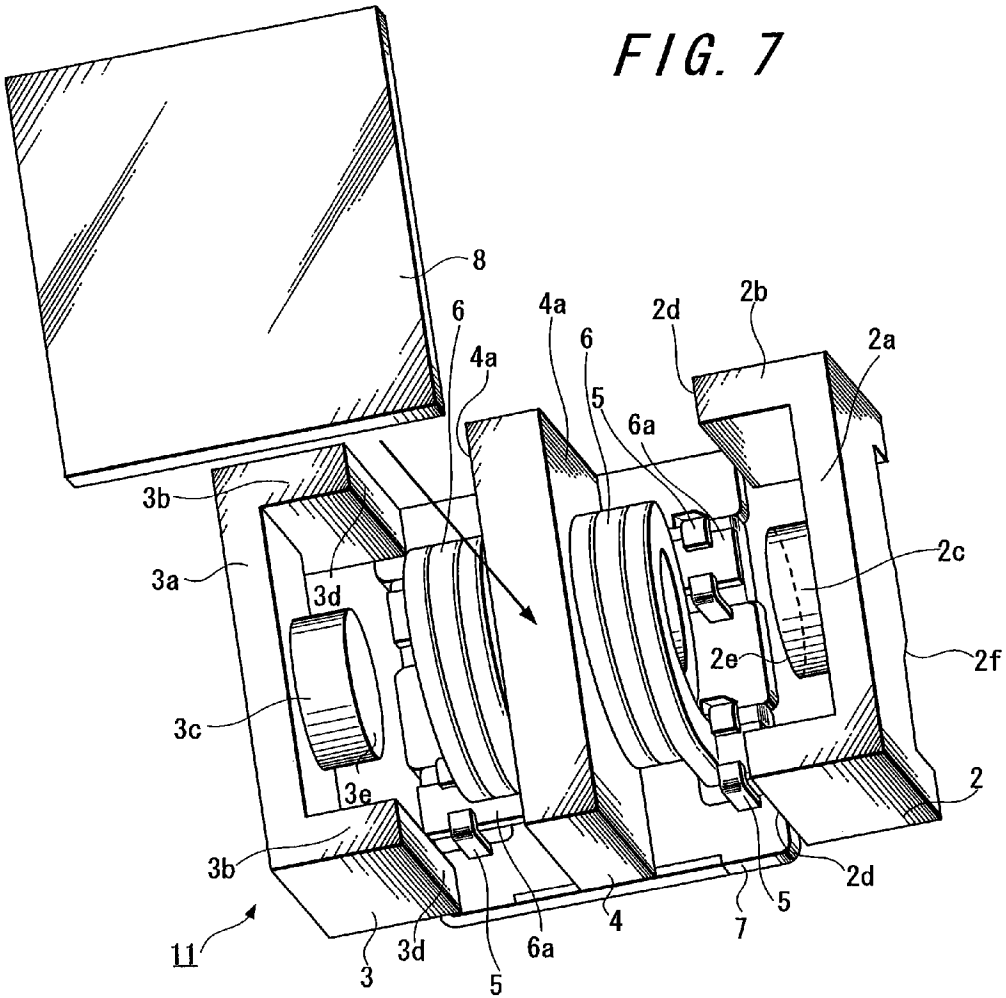
FIG. 7 is an exploded perspective view of a magnetic element according to another embodiment of the present invention.

FIG. 7 is an exploded perspective view of a magnetic element according to another embodiment of the present invention. In FIG. 7, it should be noted that the same reference numerals are given to those corresponding to FIG. 2 and duplicated explanations thereof are omitted.

As shown in FIG. 7, a magnetic shield plate 8 is provided on an upper side of the first core 2, second core 3 and intermediate core 4 in an inductance element 11 of this embodiment. The magnetic shield plate 8 is formed of a magnetic plate of high magnetic permeability and a plate-formed member which is a mixture of resin and magnetic powder, for example.

Figure 8:
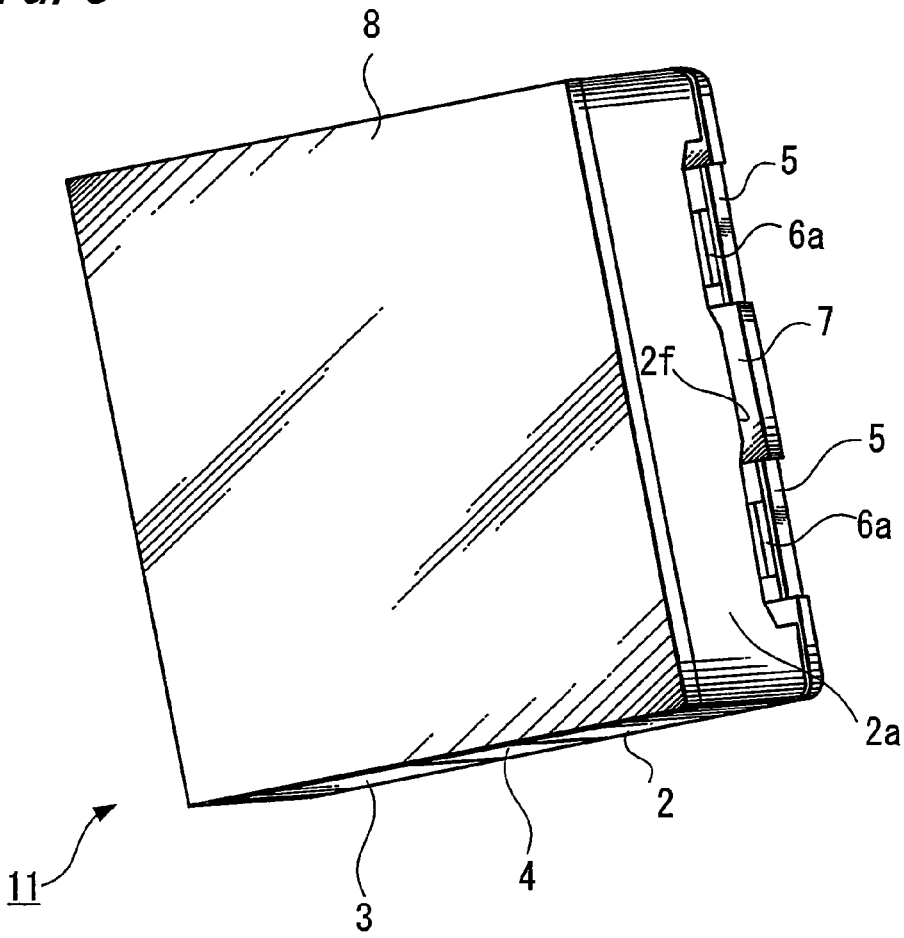
FIG. 8 is a perspective view of the magnetic element according to another embodiment of the present invention.

FIG. 8 is a perspective view of the magnetic element according to another embodiment of the present invention. In FIG. 8, it should be noted that the same reference numerals are given to those corresponding to FIG. 2 and duplicated explanations thereof are omitted.

As shown in FIG. 8, the inductance element 11 of this embodiment is assembled such that an upper surface of the first core 2, an upper surface of the second core 3 and an upper surface of the intermediate core 4 are adjacent to one another to form one plane. Further, the magnetic shield plate 8 is attached to this plane in a manner covering the coils 6 which are disposed respectively between the first core 2 and the intermediate core 4, and between the second core 3 and the intermediate core 4. Then, the inductance element 11 is mounted on a mounting substrate by soldering.

According to the inductance element 11 of this embodiment, it is possible to prevent such a trouble that magnetic flux leaks from the upper portion of the inductance element 11 since the magnetic shield plate 8 is provided on the upper portion of the element. Accordingly, it is possible to provide with the highly reliable inductance element 11 which rarely affects other magnetic elements mounted on the substrate.

It should be noted that the magnetic material used for forming the first core, the second core and the intermediate core is not limited to Mn—Zn type ferrite but it is possible to use a magnetic material such as Ni—Zn type ferrite, metal type magnetic material and amorphous type magnetic material.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A magnetic element comprising:

coils;

a first core and a second core each of which has a planar plate portion, outer leg portions extending from the planar plate portion and a middle leg portion also extending from the planar plate portion and which is inserted into said coil; and an intermediate core which forms a closed magnetic circuit and which is disposed between said first core and said second core in a manner connecting integrally with said first core and said second core, wherein, the magnetic element has the following relations:

S1<S3 and S1<S2, a cross-sectional area of the middle leg portion of said first core in a direction orthogonal to the direction in which the outer leg portion of said first core extends is S1;

a cross-sectional area of said intermediate core in a direction parallel to the direction in which said outer leg portion of said first core extends is S2; and a cross-sectional area of the middle leg portion of said second core in a direction orthogonal to the direction in which said outer leg portion of said second core extends is S3.

2. A magnetic element according to claim 1, wherein the magnetic element has a gap between said intermediate core and a top end portion of said middle leg portion of at least one of said first core and said second core.

3. A magnetic element according to claim 2, wherein said gap inserting includes a spacer therein.

4. A magnetic element according to claim 2, wherein a gap is magnetic gap resulting from an effective magnetic permeability of the intermediate core being lower than that of said first core and second core.

5. A magnetic element according to claim 1, further comprising:

a resin base on one side of said magnetic element; and a terminal member on the resin bases and configured to be mounted on a mounting substrate.

6. A magnetic element according to claim 1, further comprising a magnetic shield plate.

7. A magnetic element according to claim 6, wherein said magnetic shield plate is formed of a resin member mixed with a magnetic powder.

8. A magnetic element according to claim 1, wherein said coil is an edgewise wound coil of a flat wire.

* * * * *